US005367803A

United States Patent [19]

Albin

[11] Patent Number: 5,367,803

[45] Date of Patent: Nov. 29, 1994

[54] PICTURE FRAME CONSTRUCTION AND BRACE THEREFOR

[76] Inventor: Stephen D. Albin, 797 Manor Way, Los Altos, Calif. 94022

[21] Appl. No.: 940,079

[22] Filed: Sep. 3, 1992

[51] Int. Cl.[5] ..... B44C 5/02

[52] U.S. Cl. ..... 40/152.1; 40/158.1

[58] Field of Search ..... 40/152, 152.1, 155, 40/156, 154, 153, 157, 158.1, 159.1; 160/371, 379, 380; 38/102.4, 102.5, 102.7

[56] References Cited

U.S. PATENT DOCUMENTS

| | | | |
|---|---|---|---|
| 3,830,278 | 8/1974 | Packer | 40/152 |
| 3,883,974 | 5/1975 | Ashton | 40/152 |
| 4,055,319 | 10/1977 | Pendock | 248/491 |
| 4,069,998 | 1/1978 | Rytting | 248/476 |
| 4,083,525 | 4/1978 | Rath | 248/896 |
| 4,290,530 | 9/1981 | Wooster | 40/152 |
| 4,315,615 | 2/1982 | Scocozza | 248/489 |
| 4,340,199 | 7/1982 | Brock | 248/544 |
| 4,373,279 | 2/1983 | Abel et al. | 40/152.1 |
| 4,455,756 | 6/1984 | Greene | 33/180 R |
| 4,566,665 | 1/1986 | Rynearson | 248/495 |
| 4,837,954 | 6/1989 | Shultz | 40/152 |
| 4,892,284 | 1/1990 | Kelrick | 248/476 |
| 5,050,324 | 9/1991 | Casull | 40/152 |
| 5,052,136 | 10/1991 | Poggiolini | 40/152 |
| 5,095,641 | 3/1992 | Dahl | 40/152 |

*Primary Examiner*—Clifford D. Crowder
*Assistant Examiner*—Larry D. Worrell, Jr.
*Attorney, Agent, or Firm*—Julian Caplan

[57] ABSTRACT

A metal or wooden picture frame is provided with a traverse brace which comprises a channel having inward turned flange edges. A T-shaped fitting has means for attachment to the frame and a leg which is narrower than the space between the channel flanges but wider than the space between the inturned edges. A lock screw threaded through a tapped hole in the leg is tightened against the channel web, forcing the leg against the inner surfaces of the inturned edges and thus locking the brace to the frame. In one form of the invention the opposite end of the brace is locked to the opposite side of the frame by a similar fitting. Alternatively, a strap may be tightened to opposed brace sections. In a modification, an eye engageable with a picture hook may be locked to the brace. In another modification, an arm may be locked to the channel to extend laterally to receive a screw having a knob bearing against the back of a print, etc, within the frame to prevent sagging. A metal frame may be formed of channels secured together by angular fittings locked by similar means or channel sections may be attached to wooden frame members and secured by similar means.

15 Claims, 6 Drawing Sheets

PICTURE FRAME CONSTRUCTION AND BRACE THEREFOR

BACKGROUND OF THE INVENTION

1. Field of the Invention

This invention relates to a new and improved picture frame construction using a brace between opposed sides of the frame, the brace being connected to the sides of the frame by fittings of novel construction. In addition, the invention relates to the use of a strap between brace sections to apply tension to the opposed frame sides. A tightener to tighten a print or other pictorial representation against picture glass is likewise provided, as are means for hanging the picture and means for assembling metal frame parts.

2. Description of the Related Art

Metal frames and the use of tighteners or braces for wooden frames are known in the art, although the structure thereof is considerably different from the structure of the present invention. The present invention provides a much more rigid frame structure by reason of the improved means for attachment of the brace to the sides of the frame.

SUMMARY OF INVENTION

A brace extends across the back of a picture frame and is attached to the sides of the frame by T-shaped fittings. The brace comprises a channel having inturned edges. The sides of a metal frame may be provided with channel sections resembling those of the brace or the fitting may be attached to the metal frame member by other means, and the fitting may also be attached to a wooden frame member. The fitting has a leg which is wider than the space between the inturned edges of the channel but narrower than the space between the sides of the channel. A tapped hole in the leg receives a lock screw similar to a set screw which is tightened against the web of the channel, forcing the leg away from the web into tight engagement with the inturned edges, thereby locking the fitting to the brace. Similar means may be used to attach the arms of the fitting. The arms of the bracket may be attached to a metal frame channel by similar lock screws or a fastener such as a wood screw may be used to attach the arms to a wooden frame member. Accordingly, a very rigid structure is provided.

In a modification, two spaced apart channel sections are attached by fittings to opposed frame members. A tightening strap is fixed to one of the brace sections and, after the strap has been tightened, is also fixed to the opposite brace section by a locking screw which locks the free end of the strap against the inside of the web of the channel. Such as tightening device may be used with a wooden frame as well as a metal frame.

The brace may be either parallel to the plane of the picture or at right angles thereto.

The metal frame may also be used as a means for hanging a board on which a picture is mounted. The metal frame joined together in a rectangle as heretofore described is secured to the back of the board by adhesive or other means. The channel-shaped frames receive fittings which have hooks or eyes which may be used with fasteners secured to a wall to hang a picture.

One of the problems in picturing framing is the tendency of a print or other frame material to sag. In accordance with the present invention, a tightener is provided which is secured to the brace in a manner similar to that by which the fittings are secured to the brace and has a lateral extension which carries a threaded hole receiving the threaded shank of a knob. Since the fastener is rigidly attached to the brace, turning the shank to bring the knob into contact with the backing for the print approximately at the center of the print prevents any tendency of the print to sag.

Another feature of the invention is its use in the construction of a shadow box. Channel sections resembling those of the brace are joined together in a rectangular shape. The corners are formed by means of an angle member having tapped holes to receive locking screws. The assembled rectangular member may function as a spacer to spacer the print or other pictorial representation behind the glass of the frame. Preferably a spring clip applies pressure to the backing, biasing it against the spacers.

Another feature of the present invention is the provision of means locked into the channel of a frame having provisions for securing the frame to a picture hook.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
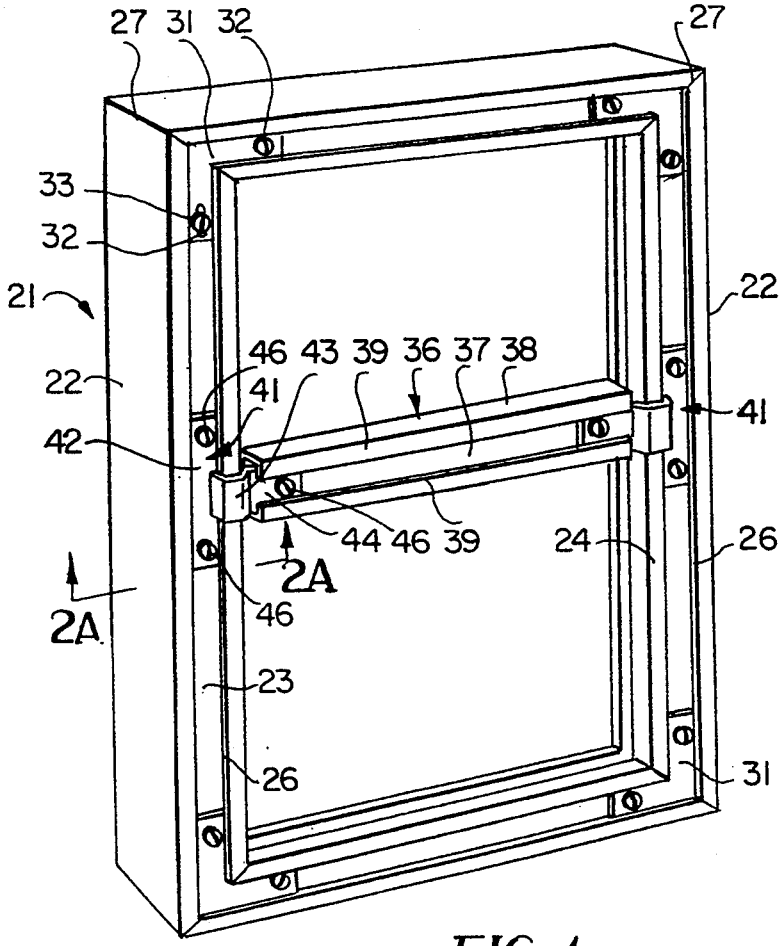
FIG. 1 is a perspective view of one embodiment of the present invention applied to a metal picture frame.
Figure 4:
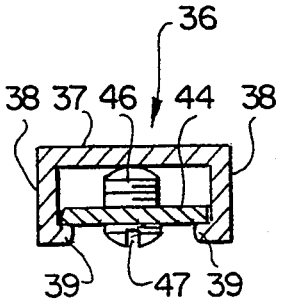
FIG. 4 is an enlarged sectional view taken substantially along line 4—4 of FIG. 3A.

Directing attention to FIG. 1, a metal picture frame 21 with which the present invention may be used is illustrated. Frame 21 comprises sides 22 each of which at the rear of the frame 21 has a channel web 23 and a flange 24 parallel to and spaced inwardly of side 22. Side 22 as well as flange 24 have inturned edges 26. The construction of frame 21 is otherwise typical. In the particular form of the invention illustrated in FIG. 1, there are mitered corners 27. A preferred means for securing the corners together is the use of an angular corner piece 31 having tapped holes. The width of the corner piece 31 is less than the distance between the side 22 and flange 24 but greater than the space between the inturned edges 26. Hence the corner piece 42 may be inserted in the channels before the corner is drawn together. Locking screws 32, similar to set screws, are threaded through tapped holes in the corner piece 42 and bear against the web 23. By use of a screw driver positioned in the slots 33, the screws 32 are tightened, causing the corner piece to bear against the inturned edges 26, securing the corners together. The picture itself is held within the frame by lips 29 around the inner front edges of sides 22.

In order to rigidify the structure heretofore described, a transverse brace 36 is provided. In cross section, the brace 36 resembles the channels in the rear portion of the sides 22. Thus there is a web 37 with upstanding flanges 38 having inturned edges 39. Brace 36 is attached to frame 21 by means of fittings 41. Each fitting 41 is T-shaped, having arms 42 which fit into the channels in the frame, having a width less than the space between side 22 and flange 24 but greater than the space between the inturned edges 26. An offset 26 is formed so that the fitting may fit around the flange 24. Outward of offset 43 is a leg 44 which is tapped to receive a lock screw 46 provided with a screw driver slot 47. Similar screws 46 are threaded into tapped holes in the arms 42. The fitting 41 may be slid along the side 22 to the desired position; and when once in position, the screws 46 are tightened so that they bear against the web 23 and force the arms 42 outward to lock against the insides of the inturned edges 26. Similarly, screw 46 in leg 44 is tightened against the web 37 of brace 36, causing the leg 44 to lock against the insides of the inturned edges 39. A similar fitting 41 is applied at the opposite end of brace 36. The use of the brace 36 thus locks the opposed sides 22 together and rigidifies the frame 21.

Figure 2A:
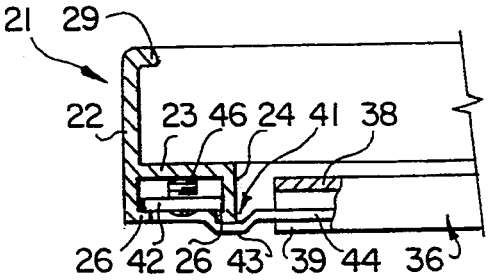
FIG. 2A is a fragmentary sectional view taken substantially along the line 2A—2A of FIG. 1.
Figure 2B:
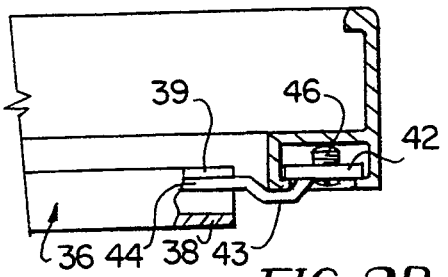
FIG. 2B is a view similar to 2A with the brace inverted.

FIG. 2A shows the structure of FIG. 1. On the other hand, as shown in FIG. 2B the brace 36 may be inverted from the position shown in FIG. 2A with the web 38 rearmost, whereas in FIG. 2 it is innermost.

Figure 3A:
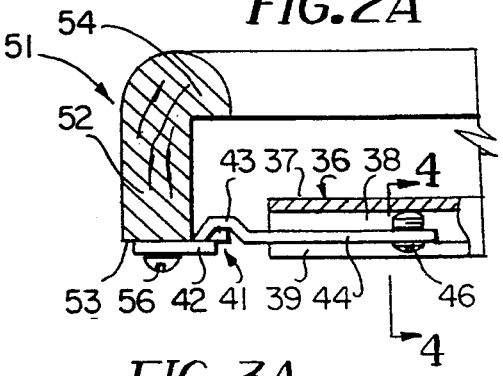
FIG. 3A is a view similar to FIG. 2A showing the invention applied to a wooden frame.
Figure 3B:
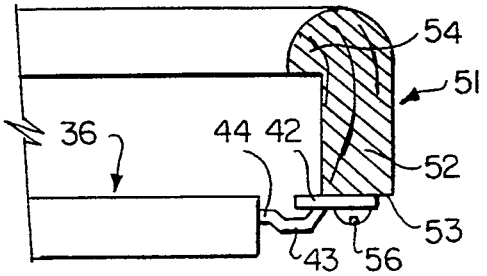
FIG. 3B is a view similar to FIG. 2B showing the invention applied to a wooden frame.
Figure 5:
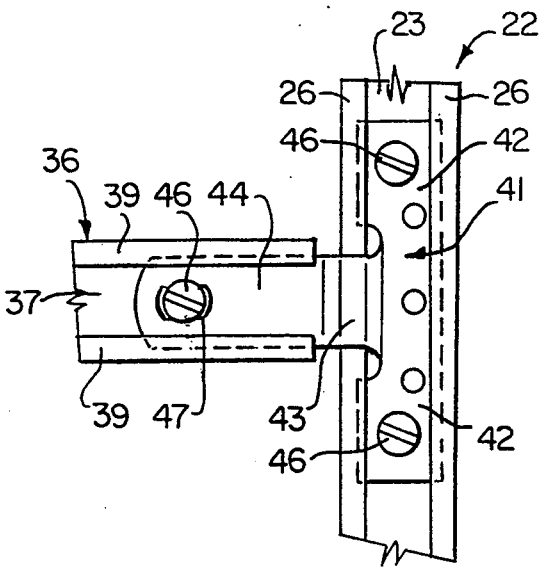
FIG. 5 is an enlarged fragmentary plan view showing a portion of a frame and a brace connected by a fitting.

Directing attention to FIGS. 3A and 3B, the use of the brace 36 with a wooden frame is illustrated. Thus the wood frame section 51 is formed with a side 52 having a flat outer edge 53. The opposite end of section 51 has a inward turned lip 54 which retains the picture held in the frame in place. Fittings 41, similar to the fittings shown in FIGS. 1, 2A and 2B, may be attached to surface 53 by wood screws 56, nails or other means. The offset 43 is preferably positioned inward as shown in FIG. 3A, whereupon the brace 36 is recessed within the confines of the sides 52. On the other hand, as shown in FIG. 3B, the offset 43 extends outward and the brace 36 is reversed from the position shown in FIG. 3A.

Figure 6:
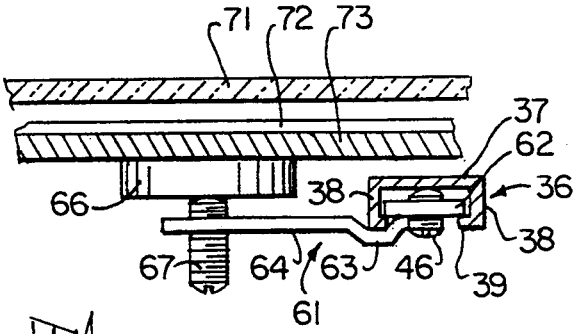
FIG. 6 is a fragmentary sectional view showing the use of a tightener attached to a brace.

Directing attention now to the structure shown in FIG. 6, tightener 61 is attached to brace 36. Tightener 61 comprises a leg 62 parallel to brace 36 and disposed within the same. It is fixed in position by means of lock screw 46 which, when tightened against the web 37, causes the leg 62 to be clamped against the insides of the inturned edges 39. Offset 63 extends over side 38 of brace 36 and lateral extension 64 extends outwardly of the brace 36. Knob 66 has a threaded shank 67 threaded through a tapped hole in extension 64. A portion of a typical picture assembly is shown in FIG. 6 comprising a glass 71, a print 72 or other artistic material and a backing 73 of cardboard, corrugated paper or the like. By turning knob 66 or its shank 67, the knob 66 may be brought against the backing 73 thereby preventing the print 72 from sagging or shifting position. Tightener 61 is particularly effective since knob 66 may be positioned to contact backing 73 at about its middle.

Figure 7:
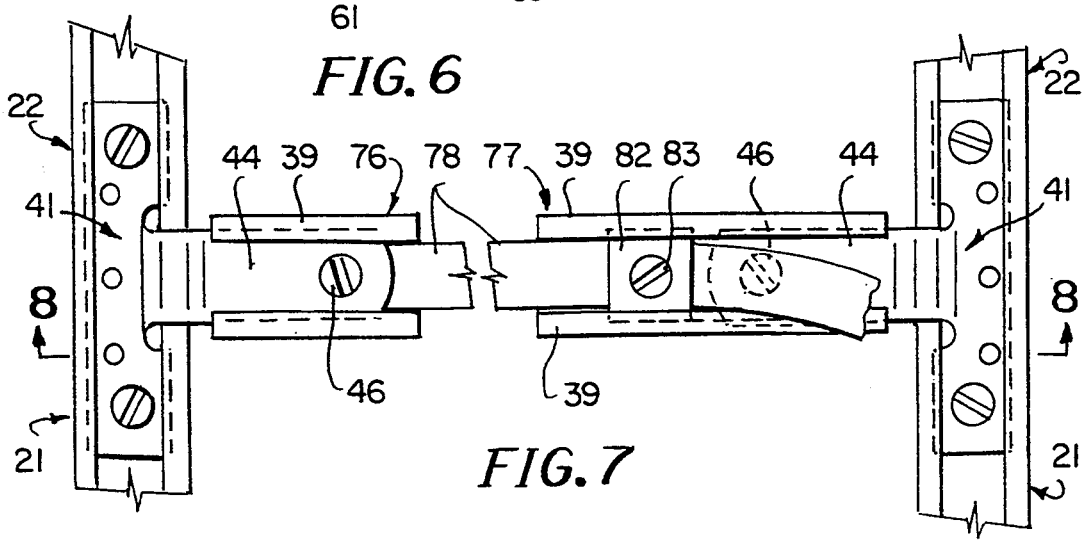
FIG. 7 is a plan view partly broken away in section showing an alternate brace.
Figure 8:
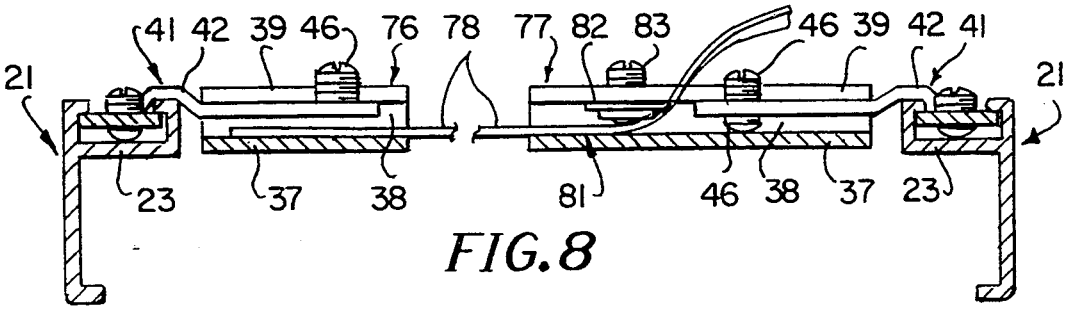
FIG. 8 is a sectional view taken substantially along the line 8—8 of FIG. 7.

FIGS. 7 and 8 show an alternate brace. Thus instead of the brace extending from side to side of the frame, there are first and second channel sections 76 and 77 separated by a substantial gap. Bridging the gap is a strap 78 of a material which is relatively non-resilient. First channel section 76 is secured to the left-hand frame section by a fitting 41. The screw 46 which locks the leg 44 in position also bears against one end of strap 78 (see FIG. 8).

The second channel section 77 is secured by means of another fitting 41 to the opposite side of the frame. At the inner end of channel 77 there is a edge engaging member 82 held in place by screw 83. The right-hand end of strap 78 passes under screw 83.

In the assembly of FIG. 7 and 8, after the channel sections 76 and 77 have been secured by means of fittings 41 to their respective frame sides, and after one end of strap 78 has been secured in position by the screw 46 of section 76, the user pulls on the free end of the strap 78 and then tightens the screw 86, locking the strap 78 in place. By reason of the non-resilient nature of strap 78, the frame is braced in positioned with results similar to those achieved in the structure of FIG. 1.

Figure 9:
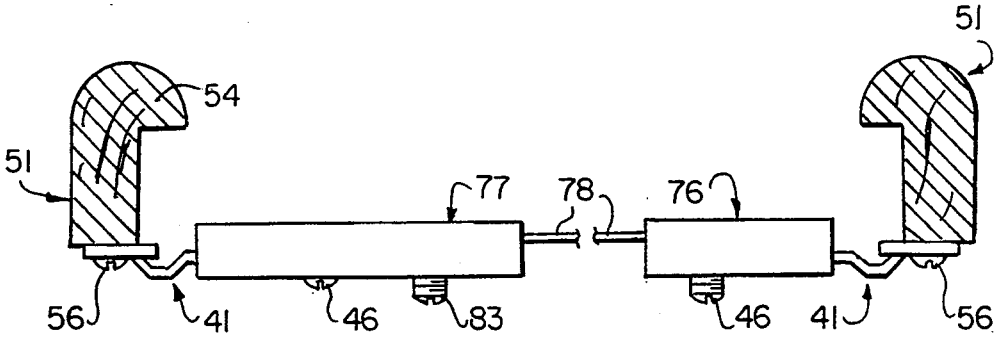
FIG. 9 is a view similar to FIG. 8 showing a brace of FIG. 7 and 8 applied to a wooden frame.

FIG. 9 shows adaptation of the strap technique of FIG. 7 and 8 to wood frame sections 51, 51. The fittings 41 are secured by means of screws 56 or other fasteners in the same manner as in FIGS. 3A and 3B. Similarly, the channel sections 76 and 77 are secured to fittings 41, 41. The right-hand end of strap 78 (as viewed in FIG. 9) is held in place by screw 46. After the section 76 and 77 have been locked to their respective fittings 41, the user pulls the strap 78 and then tightens screw 83.

Figure 10:
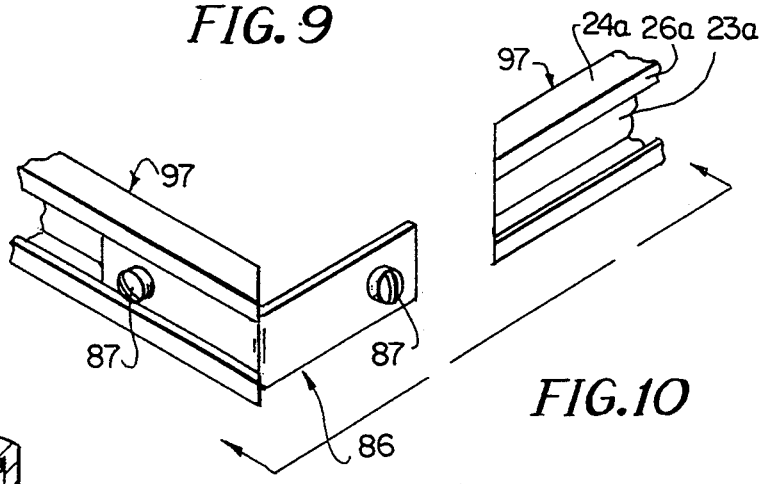
FIG. 10 is an exploded perspective view showing attachment of the corners of a metal frame or spacer.

FIG. 10 shows one type joint for channel sections 97, the cross-section of sections 97 being the same as the cross-sections of the brace 36. A right angle 86 is installed in the channel sections 97. The ends 88 are mitered. The two sections 97 are installed over the opposite flanges of the angle 86. The screws 87 threaded into tapped holes in the flanges of the angle 86 are tightened against the webs **23*a* causing the flanges to bear tightly against the inturned edges 26*a*, locking the two sections 97** together at right angles with respect to each other.

Figure 12:
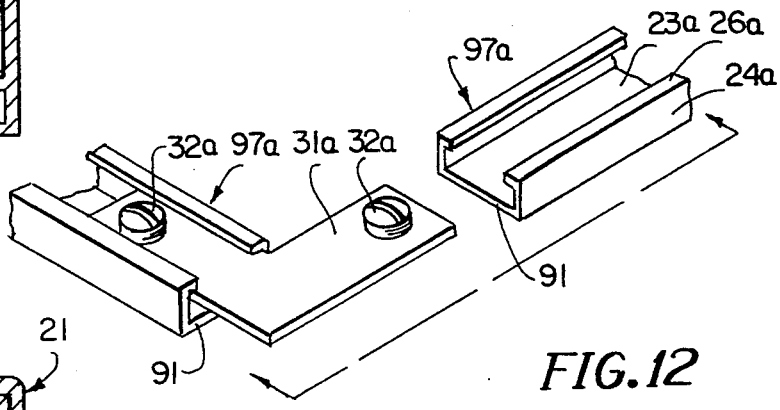
FIG. 12 is a view similar to FIG. 10 of a modified construction.
Figure 16:
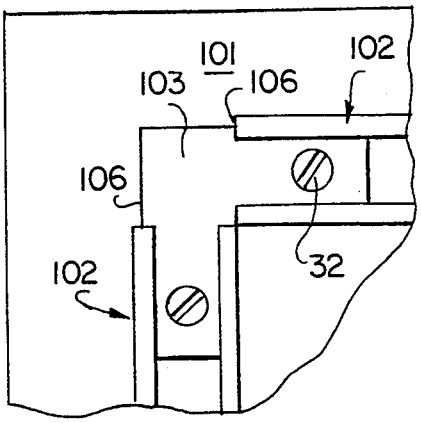
FIG. 16 is a fragmentary view showing an alternate means for joining the corners of the frame sections of FIG. 14.

FIG. 12 shows a modification of the structure of FIG. 10 In this modification, the ends 91 of the channel sections **97*a* are square. Corner piece 31*a* resembles the corner piece 31 of FIG. 1. When the sections 97*a* are held together, there is a gap at the corner. Such a gap is suitable for use as a spacer (see FIG. 13) or also if the channel sections 97*a* are attached to the back of a board 101 as shown in FIG. 16. In these instances (as well as others not illustrated) the fact that the corner is not mitered does not matter since the channels 97*a* are not exposed to view when the picture is hung on the wall. In other respects the structure of FIG. 12 is similar to that of FIG. 10** and in the same reference numerals followed by the subscript *a* are used to designate corresponding parts.

Figure 11:
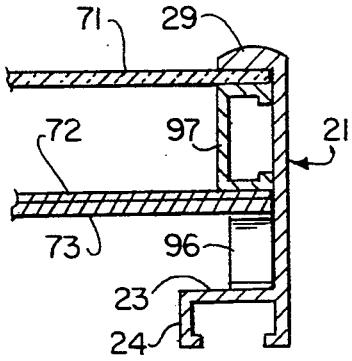
FIG. 11 is a sectional view through a frame showing the use of the structure of FIG. 10 used as a spacer.

FIG. 11 shows use of a spacer such as shown in FIG. 10 in a picture frame. Frame member 21 resembles the frame member 21 shown in FIG. 1. Glass 71 is retained upon the lip 29 of the metal frame member 21. The print or other work of art 72 is spaced behind the glass 71 by spacer 97 similar to the spacer 97 shown in FIG. 10. Spring clip 96 is installed behind the backing 73 for the print 72 and bears against backing 76 as well as against channel web 23. Spring clip 96 is merely a bent section of spring steel which tends to unbend and thus applies pressure to the members 73 and 23.

Figure 13:
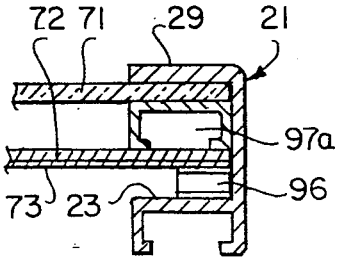
FIG. 13 is a view similar to FIG. 11 showing the construction of FIG. 12 used as a spacer.

FIGS. 13 shows a structure similar to FIG. 7 except that the spacer **97*a* (shown in detail in FIG. 12) is thinner and the metal frame section 21 is shallower. The spring clip 96*a* is likewise smaller than the corresponding clip 96 shown in FIG. 11**.

In the metal frames illustrated heretofore, the channels receiving the fittings 31 and 41 have been an integral portion of the frame. Directing attention now to the structure of FIG. 14, the picture is mounted on the exposed surface of board 101. Channel section sides 102 may be attached to the reverse of board 101 as by adhesives (including double-stick adhesive tape, not shown) or by screws or other satisfactory means. The channel section sides 102 are held together by corner pieces 103. In the form of the invention shown in FIG. 14 the corners 104 are mitered. In FIG. 16, however, the corners 106 are square. In both instances, corner pieces 103 fit into the ends of the channels 102 and are locked in place by screws 32 in the same fashion as corner pieces 31 of FIG. 1.

Figure 14:
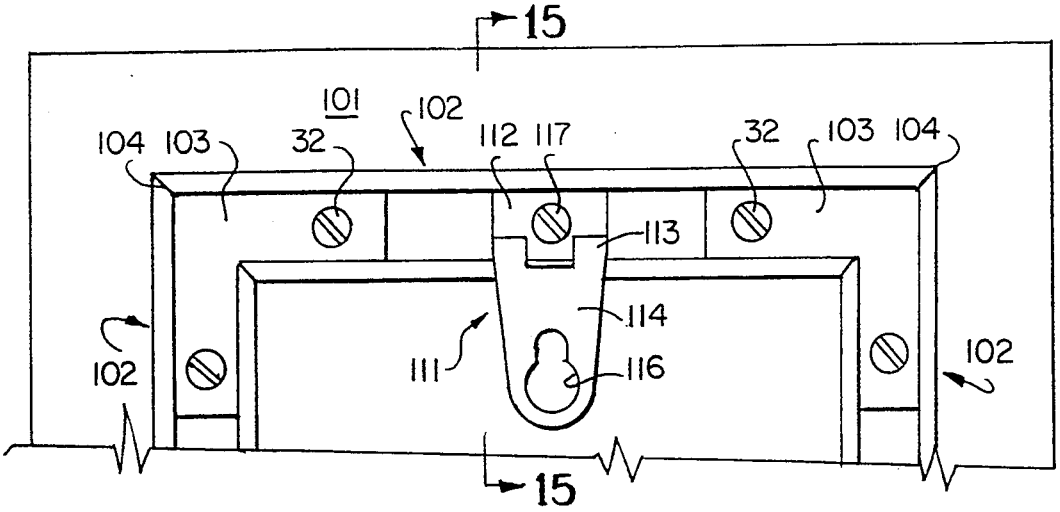
FIG. 14 is a fragmentary plan view of a modified structure showing the use of a metal frame applied to the back of a board on which a picture is mounted and showing means for attachment of the assembly to a wall hanger.
Figure 15:
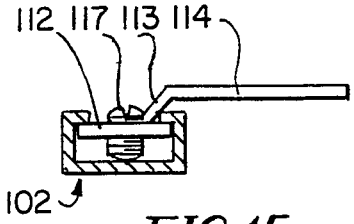
FIG. 15 is a sectional view taken substantially along the line of 15—15 of FIG. 14 turned 90°.

Another detail of the invention is shown in FIGS. 14 and 15. A hook fitting 111 used for mounting the board 101 to a wall is installed in one of the channel section sides 102. Fitting 111 has a base 112 dimensioned to fit within the sides of a channel 102 but larger than the distance between the inturned edges thereof. Offset 113 extends up over the flange of channel 102 and is integral with strap 114 which may extend downward or upward from channel 102. The outer end of strap 114 is formed with a key hole to hang fitting 111 and thereby hang board 101 to a screw, nail or picture hook installed in a wall.

Figure 18:
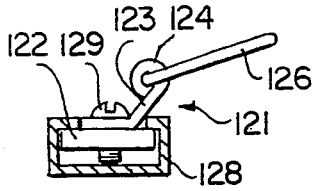
FIG. 18 is a sectional view taken along the line 18—18 of FIG. 17 turned 90°.
Figure 17:
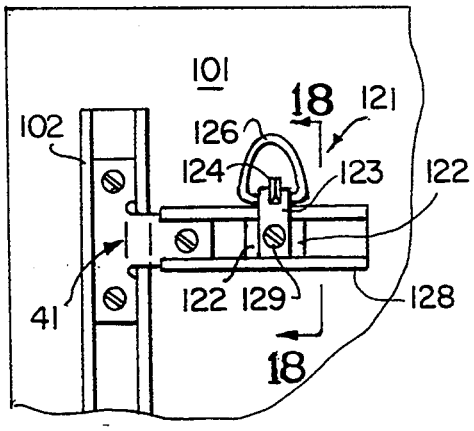
FIG. 17 is a fragmentary plan view showing use of a short brace section as means for mounting a board on a wall.

An alternate means for hanging the picture on a wall is shown in FIGS. 17 and 18. For such purpose an eye fitting 121 is used. Fitting 121 has a base 122 dimensioned to fit into the channel 128 but being wider than the space between the inturned edges thereof. It is secured by screw 124. Extending upward at an angle from base 122 is staple 123 formed with a loop 124. Eye 126 is captured in the loop 124 and may be used to hang a picture in the same manner as the strap 114 of FIG. 14. An alternate means for mounting eye fitting 121 is shown in FIG. 17. Channel section 128 is mounted on the back of board 101 or may be attached to channel side section 102 by means of fitting 41.

Figure 19:
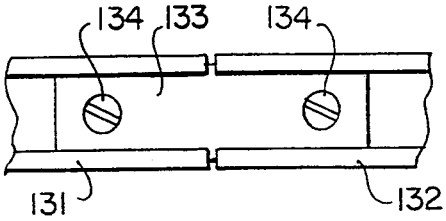
FIG. 19 is a fragmentary plan view showing splicing of adjacent frame sections.

A simple means to splice two channel sections together is shown in FIG. 19. The two sections 131 and 132 are joined by a simple bridge 133, the cross section of which is similar to that of the arms 42 of fitting 41. Screws 134 threaded into bridge 133 are tightened against the underlying web of channel sections 131 and 132 forcing the bridge 133 against the undersides of the inturned edges of the flanges of sections 131 and 132 and thereby locking the two sections in alignment.

Figure 20:
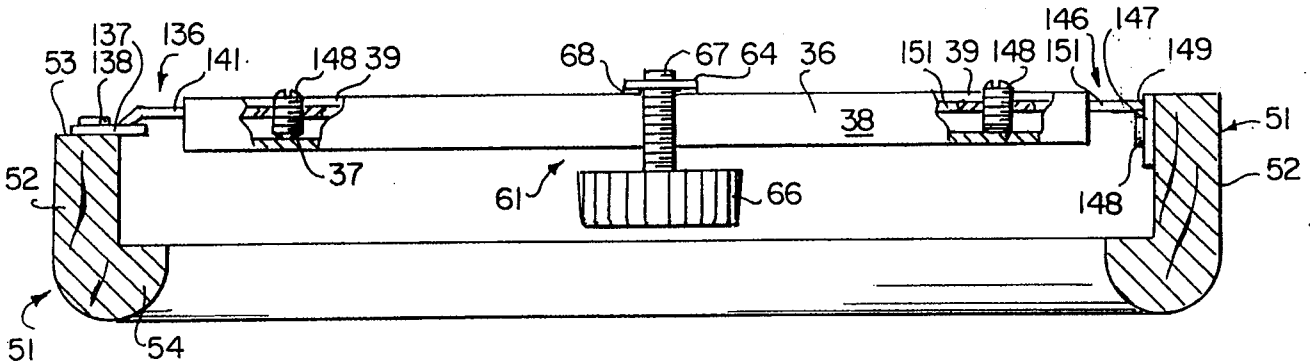
FIG. 20 is a sectional view through a modified invention showing on the left side one form of fitting connecting a frame section to a brace and on the right side a different form of fitting.
Figure 21:
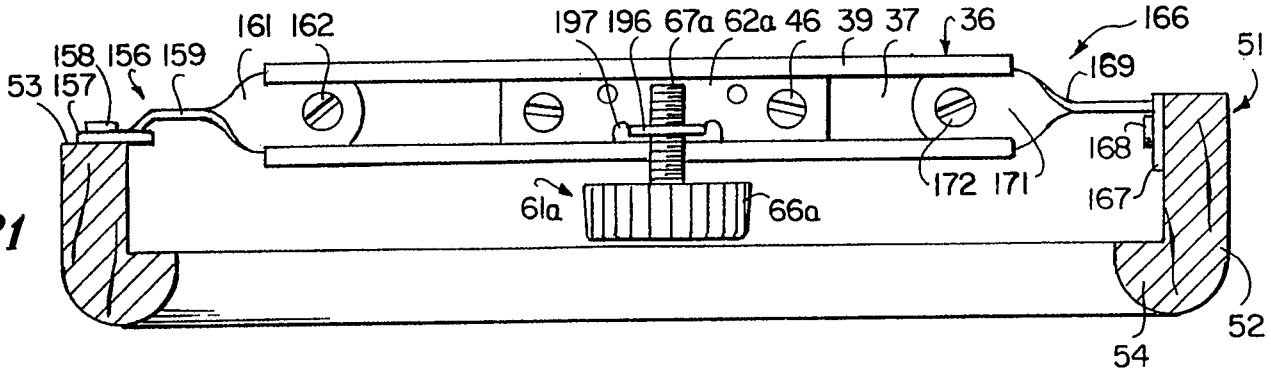
FIG. 21 is a view similar to FIG. 20 showing on the left side the use of a fitting to attach a frame to a brace turned 90° from the position of FIG. 20 and showing on the right side a different form of brace.
Figure 22:
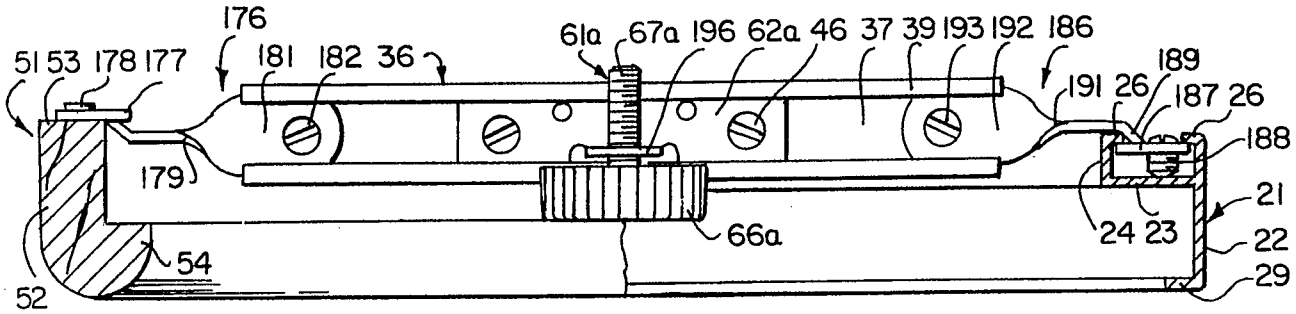
FIG. 22 is a view similar to FIGS. 20 and 21 showing on the left side the use of a modified brace and on the right side showing the use of the brace on the left side of FIG. 21 in a metal frame construction.
Figure 23:
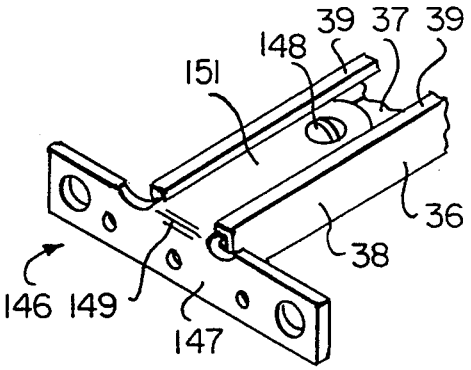
FIG. 23 is a fragmentary perspective view of the fitting on the right side of FIG. 20.
Figure 24:
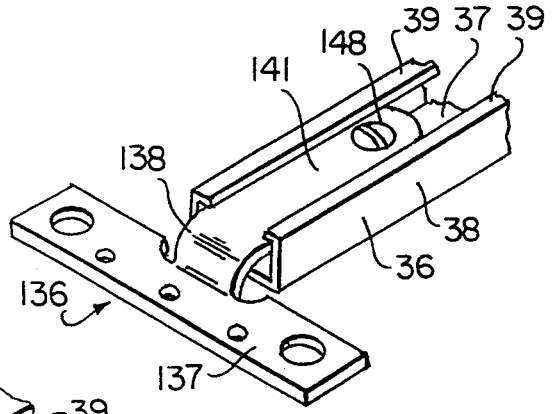
FIG. 24 is a fragmentary perspective view of the fitting on the left side of FIG. 20.
Figure 25:
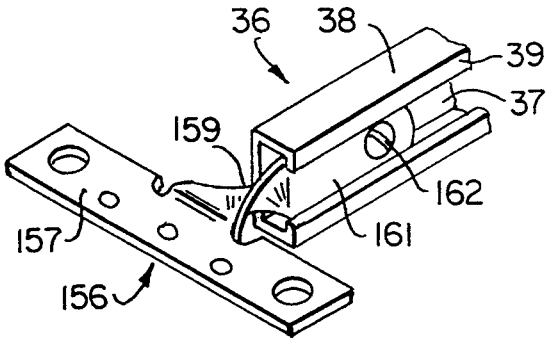
FIG. 25 is a fragmentary perspective view of the fitting on the left side of FIG. 21.
Figure 26:
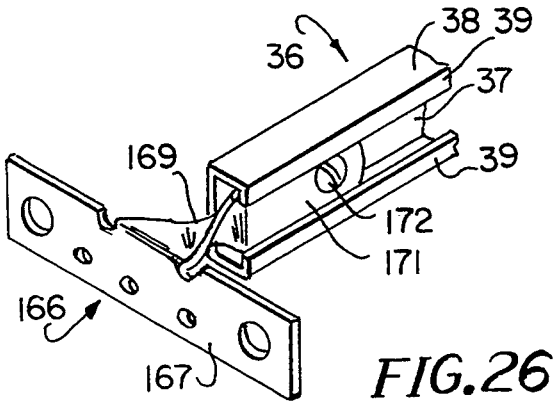
FIG. 26 is a fragmentary perspective view of the fitting on the right side of FIG. 21.

FIGS. 20–22 show the use of braces for picture frames similar to the braces shown in FIGS. 1–5 and also the use of a tightener similar to that shown in FIG. 6. For convenience, the fittings on opposite ends of each brace are different, it being understood that in actual practice the fittings would be the same. Turning first specifically to the left side of FIG. 20, fitting 136 has arms 137 which fit against the outer edge 53 of wooden frame member 51 and are held in position by fasteners 138. An upward offset 138 connects arms 137 to leg 141 which is attached to brace 36 by screws 148. It will be understood that the fitting 136 may be used on a wooden frame member 51 or, alternatively, on a metal channel similar to that shown in FIG. 2A.

The right hand of portion of FIG. 20 shows an alternate construction. In this construction, fitting 146 is attached to the inner surface of side 52 of frame member 51. The arms 147 are secured to the frame by screws 148. There is a 90° bend 149 at the intersection of leg 151 and arms 147. Screw 148 secures the leg 151 in position in each brace 36 in the same manner as heretofore described.

FIG. 20 also shows the use of a tightener 61 resembling that shown in FIG. 6.

Turning now to the left side of FIG. 21, fitting 156 has arms 157 attached to the surface 53 of frame member 51 by screws 158. There is a 90° twist intermediate portion between the arms 157 and the leg 161 which in the left side of FIG. 21 is vertical as contrasted with the horizontal position in the left side of FIG. 20. Leg 161 is secured to brace 36 by means of screw 162 in the same manner as in the preceding modifications.

The right side of FIG. 21 shows use of a fitting 166. The arms 167 thereof are attached to the inside surface of the side 52 by fasteners 168. There is a 90° twist intermediate portion 169 between arms 167 and the leg 171 held in the brace 36 by screw 172.

On the left side of FIG. 22 fitting 176 is illustrated. This fitting resembles fitting 156 except that the twisted intermediate portion 179, which interconnects arms 177 and leg 181, is bent downwardly rather than upwardly as in the left side of FIG. 21. Arms 177 are secured to surface 153 by screws 178, and leg 181 is secured to brace 36 by screws 182.

The right side of FIG. 22 shows how fitting 186, which resembles fitting 156, is used with a metal frame section 21 which resembles the frame section shown in FIGS. 2A and 2B. Fitting 186, therefore, has arms 187 which fit between the sides 24 and 22 but is wider than the base between the inturned edges 26. Arms 187 are secured in place by screws 188 in the same manner as in FIG. 2A. There is an offset 189 extending upward to clear the edge 26 and a 90° twisted portion 191 between offset 189 and leg 192. Leg 192 is secured in brace 36 by screw 193 in the same manner as in the preceding modifications.

In the modifications of FIGS. 21 and 22 tightener **61*a* resembles that in FIGS. 6 and 20 except that inasmuch as the brace 36 is perpendicular to the plane of the picture, the lateral extension 196 is at right angles to the leg 62*a* there is a bend 197 at the junction of leg 62*a* and extension 196. In other respects the tightener of FIGS. 21 and 22 resemble that if FIG. 6** in the same reference numerals followed by the subscript *a* are used to designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In combination, a pair of opposed picture frame sides, a brace extending transversely between said frame sides, said brace comprising a channel having in cross section a web, opposed flanges along either side of said web, said flanges being separated by a first space, and inturned edges along the flange sides of said flanges remote from said web, said inturned edges being separated by a second space, a fitting on each end of said brace, said fitting having first means for attachment of said fitting to a frame side, a leg extending from said first means into said brace, said leg having a width less than said first space between said flanges and greater than said second space between said inturned edges, whereby said leg fits inside said channel, and second means for locking said leg against movement within said channel, said second means being adjustable in a plurality of positions without deformation of said inturned edges.

2. The combination of claim 1 in which said inturned edges have undersides and said second means comprises means for applying force between said leg and said web to force said leg against said undersides of said inturned edges.

3. The combination of claim 2 in which said means for applying force comprises a screw threaded through a tapped hole in said leg and bearing against said web.

4. The combination of claim 1 in which said fitting is T-shaped and said first means comprises arms of the T and fastening means for securing at least one said arm to a frame side.

5. The combination of claim 4 in which said frame side comprises a second channel having in cross-section a second web, opposed second flanges along either side of said second web, said second flanges being separated by a third space and inturned second edges along said second flange sides along the edges of said second flanges remote from said second web, said inturned second edges being separated by a fourth space, said arms having a width less than said third space between said second flanges and greater than said fourth space between said inturned edges, whereby said arms fit inside said second channel.

6. The combination of claim 5 in which said fitting is formed with an offset extending over one said second inturned edge, whereby said arms and said leg of said fitting are substantially co-planar.

7. The combination of claim 5 in which said second inturned edges have undersides and said third means comprises a screw threaded through a tapped hole in one said arm and bearing against said second web to force said arm against said undersides of said second inturned edges.

8. The combination of claim 4 in which said frame sides are formed of a material which engages a wood screw and has an outer edge, said arms being fastened by said fastening means to said outer edge.

9. The combination of claim 4 in which said frame sides are formed of a material which engages a wood screw and has an inner edge, said arms being fastened by said fastening means to said inner edge, said leg being perpendicular to the plane of said arms.

10. The combination of claim 9 in which said web of said brace is at right angles to said plane of said frame sides and said leg is formed with a 90° twist adjacent the junction of said leg and said arms.

11. The combination of claim 1 in which brace comprises spaced, aligned first and second channel sections of substantially identical cross section, each channel section being connected by one said fitting to a frame side, a strap extending between said channel sections, first strap attachment means attaching one end of said strap to said first channel section and second strap attachment means attaching a second end of said strap opposite said first end to said second channel section.

12. The combination of claim 11 in which said inturned edges have undersides and said first strap attachment means comprises an edge-engaging means in said channel of said brace narrower than said first space between said flanges and wider than said second space between said inturned edges, and a locking screw threaded through a tapped hole in said edge-engaging means, said one end of said strap extending between said locking screw and said web, whereby after said strap has been tightened, turning said locking screw fixes said one end of said strap in position relative to said edge-engaging means and locks said edge-engaging means against the undersides of said inturned edges.

13. The combination of claim 1 which further comprises a tightener and means to attach said tightener to said brace, said tightener comprising an extension at an angle to said brace, a threaded shank threaded through a tapped hole in said extension and means on said shank adapted to bear against the back of a graphic representation held within said frame sides.

14. The combination of claim 13 in which said inturned edges have undersides and said means to attach said tightener comprises a leg within said channel connected to said extensions, said leg having a width less than said first space between said flanges and greater than said second space between said inturned edges and a lock screw threaded through a tapped hole in said leg beating against said web whereby when said screw is tightened against said web, said leg is locked in position against said undersides of said inturned edges.

15. The combination of claim 13 in which said means on said shank comprises a flat knob.

* * * * *